US005745928A

United States Patent [19]

Armanno, Sr.

[11] Patent Number: 5,745,928

[45] Date of Patent: May 5, 1998

[54] TOILET BOWL DISPENSING SYSTEM

[76] Inventor: Frank Armanno, Sr., 14399 Picea Ct., Fort Pierce, Fla. 34951

[21] Appl. No.: 841,590

[22] Filed: Apr. 30, 1997

Related U.S. Application Data

[63] Continuation of Ser. No. 584,239, Jan. 11, 1996, abandoned.

[51] Int. Cl.[6] ..... E03D 9/00

[52] U.S. Cl. ..... 4/225.1; 4/223

[58] Field of Search ..... 4/225.1, 226.1, 4/227.1, 223, 229, 222

[56] References Cited

U.S. PATENT DOCUMENTS

| | | | |
|---|---|---|---|
| 1,170,387 | 2/1916 | Andrews | 4/255.1 |
| 2,570,934 | 10/1951 | Foster | 4/255.1 |
| 3,105,245 | 10/1963 | Finkbiner | 4/255.1 |
| 3,311,931 | 4/1967 | Kristensen et al. | 4/255.1 |
| 4,656,676 | 4/1987 | Dufau et al. | 4/255.1 |
| 5,042,095 | 8/1991 | Schoepe et al. | 4/255.1 |
| 5,387,249 | 2/1995 | Wiecorek | 4/225.1 |

*Primary Examiner*—David J. Walczak
*Attorney, Agent, or Firm*—Richard C. Litman

[57] ABSTRACT

A toilet bowl dispensing system, that includes an agent chamber for retaining a cleaning or disinfecting agent in a separate container away from the main body of water in the toilet tank. The agent chamber is sealed with a cap having an inlet and outlet tube. The inlet tube is connected to the inlet water valve in the tank of a toilet, while the outlet tube is connected to the bowl refill tube. The chamber cap is securely connected to the chamber to provide a water tight seal, however, the cap can be removed to install a cleaning agent such as chlorine pellets. In the operation of this system, the water from the inlet valve, which normally is used to refill the bowl, is first directed through the agent chamber and past the agent to produce a metered amount of dissolved agent which enters the toilet bowl only after the toilet has been flushed. By using this system, only a known, predetermined amount of cleaning agent is dispensed into the bowl after the toilet has completed its flush cycle, allowing the dissolved agent to remain in the bowl to clean, rather than having been flushed down the waste line, as occurs in most conventional systems. The usual components contained in the water tank of a toilet are used to automatically activate and control the dispensing action. Various types and sizes of cleaning agents can be accepted and can be installed quickly since installation of any agent merely requires the removal of a cap and the loading of the agent into the agent chamber.

3 Claims, 2 Drawing Sheets

TOILET BOWL DISPENSING SYSTEM

CROSS REFERENCE TO RELATED APPLICATION

This application is a continuation of application Ser. No. 08/584,239 filed on Jan. 11, 1996, now abandoned.

BACKGROUND

A. Field

The present invention is related to devices for automatically dispensing cleaning and deodorizing agents into a toilet bowl B. Prior Art In most prior art systems, a dispensing agent in block form is placed into the tank of a toilet and left to dissolve in the relatively large amount of water contained in the tank. When the toilet is flushed, almost all of the agent that is dissolved in this body of water is quickly flushed down the waste line, with little remaining in the toilet bowl. In other prior art systems, a block of deodorizing agent is held in a support device at the side of the bowl where the flushing water passes the block and dissolves a portion of the block into the water. In this latter system, much of the agent that is dissolved in the water is also flushed down and out the waste line. The block of agent in this system must be able to dissolve quickly because it is given only a short time to dissolve in the water during the flush cycle. Unfortunately, the fast dissolving block can be quickly consumed and most of it is wasted. In addition, the block usually contains embedded wires to provide support in holding the block in position. The wires and what remains of the block must later be disposed of. In some instances, the wires used to support the block are accidentally dropped into the bowl and flushed into the waste line causing blockage and costly repairs. In either prior art system, much of the agent is wasted and special agents are required for the particular type of system in which the agent operates. These deficiencies in the prior art systems are overcome in the present invention, as disclosed in the following specifications and claims.

SUMMARY

In general, the following specifications refer to a toilet of the type that includes a tank, as opposed to a high pressure water system which does not include a tank. The tank includes a float, shut off valve and inlet refill line, as is typical in most tank type toilets currently in use.

The two principal components of a conventional toilet system are the tank and bowl. Within the tank there is a water inlet pipe which feeds water to the tank. The tank fills with water and is shut off by means of an inlet valve that is activated by a float. The float shuts the inlet valve off when the float rises to approximately three quarters the height of the tank. When the toilet is flushed, a flapper valve located above an exhaust port is opened and the water stored in the tank is quickly released through the exhaust port into the toilet bowl. Most of the water from the tank passes through the toilet bowl and on to the wasteline. The flapper valve closes after the water has been released into the bowl, but water continues to flow into the bowl to rinse the side walls of the bowl and also to refill the bowl. This is done by means of a secondary flow path which does not pass through the flapper valve. The secondary flow path takes a small amount of water from the inlet valve and passes it through a refill tube, which allows this water to bypass the flapper valve and flow into the bowl.

Once the flapper valve closes, the water passing through the inlet valve slowly fills the tank. The float rises with the water in the tank until it reaches its inlet valve shut off position. During the tank refill period, the secondary path allows water to continue to flow into the bowl. The amount of water flowing through the secondary path is typically one tenth to one quarter the amount passed through the main exhaust port during a normal flush cycle. The flush cycle begins when the flapper valve opens and ends when the flapper valve closes. The refill cycle begins when the inlet valve opens and ends when the inlet valve closes. The flush cycle includes the action to open the flapper valve and also the action to close the flapper valve. Similarly the refill cycle includes all the actions associated with refilling the tank and the bowl including the action to open the inlet valve and the action to close the inlet valve.

In the present invention, there is a change from the conventional secondary flow path. The secondary flow path is interrupted to place a sealed agent chamber in series with this path. A cleaning and deodorizing agent, such as chlorine pellets, is placed in the sealed agent chamber. Access to the chamber is obtained by removing its cap. After the removal of the cap and the placing of the cleaning agent in the agent chamber, the cap is replaced to reseal the chamber. The water used to refill the bowl passes through the agent chamber, where the agent is dissolved into the water. This water then flows out of the chamber and into the bowl refill tube where it is finally released into the bowl. Only the water from the secondary path, which is essentially not lost in the flush cycle, is passed to the bowl and remains in the toilet bowl between flush cycles. Therefore, the cleaning agent dissolved in the water in the secondary path is not wasted by being flushed down with the main body of water, but instead remains in the toilet bowl to clean and deodorize at full strength between flush cycles. Less agent is used then in prior art systems and better cleaning and deodorizing is achieved. Since the chamber can hold various sizes and types of agents, the most economical agent or combination of agents can be selected to insure low cost, efficient operation.

DETAILED DESCRIPTION OF THE INVENTION

To improve the effectiveness of cleaning and deodorizing agents used in toilets, the present invention avoids dissolving the agent into the main body of water in a toilet tank. Instead, the present invention places the agent in a sealed agent chamber which only accepts the much smaller amount of water used to refill the toilet bowl. The refill water flows principally after the flushing action has been completed. In this way, the agent is at full strength and remains in the toilet bowl only rather than being flushed away down the waste line during the flush cycle.

Figure 1:
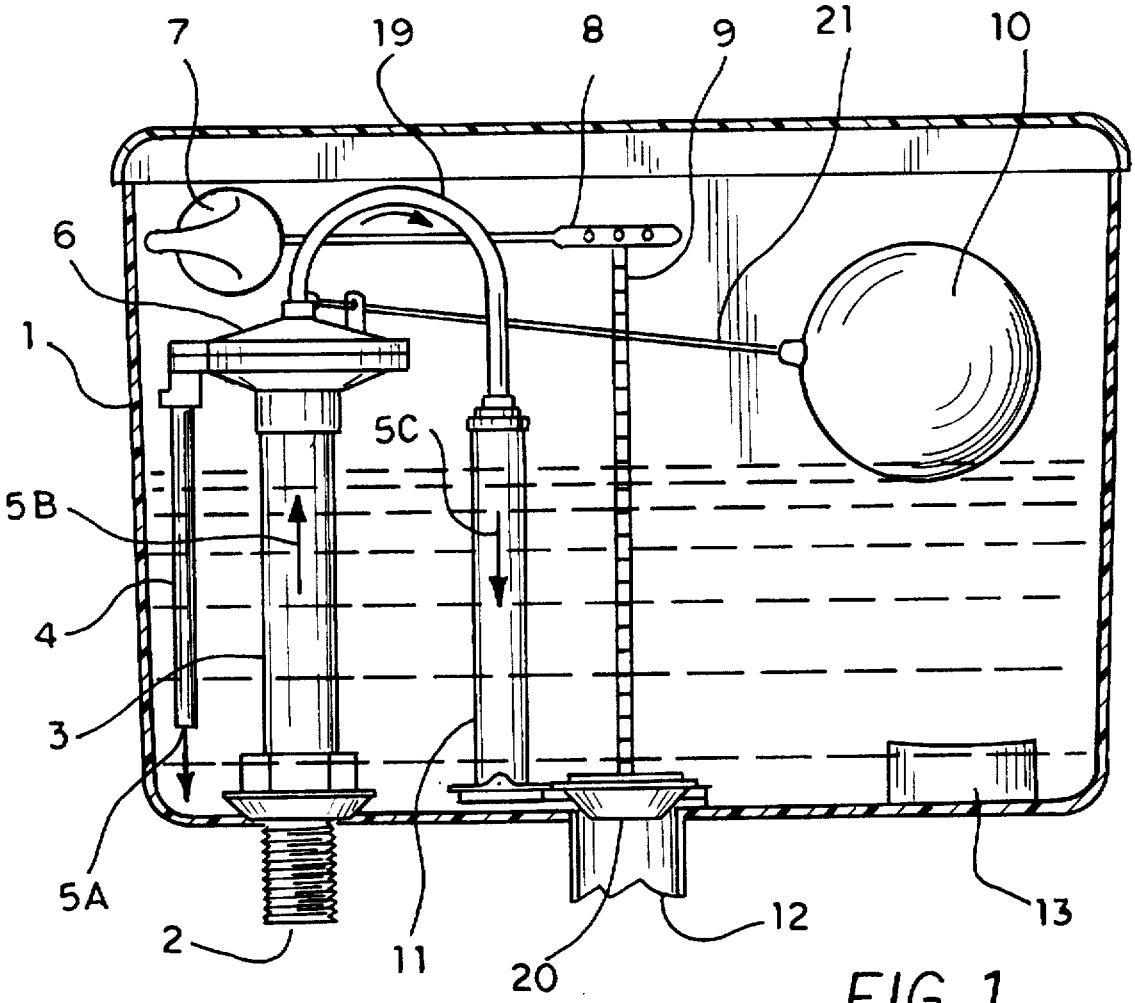
FIG. 1 (PRIOR ART)
FIG. 1 is a cross sectional view of the tank of a conventional toilet showing the internal components and the direction of water flow.
Figure 2:
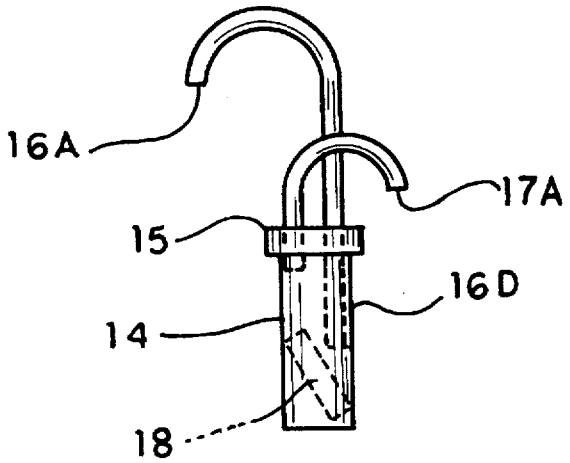
FIG. 2 is a detailed view of the sealed agent chamber.
Figure 3:
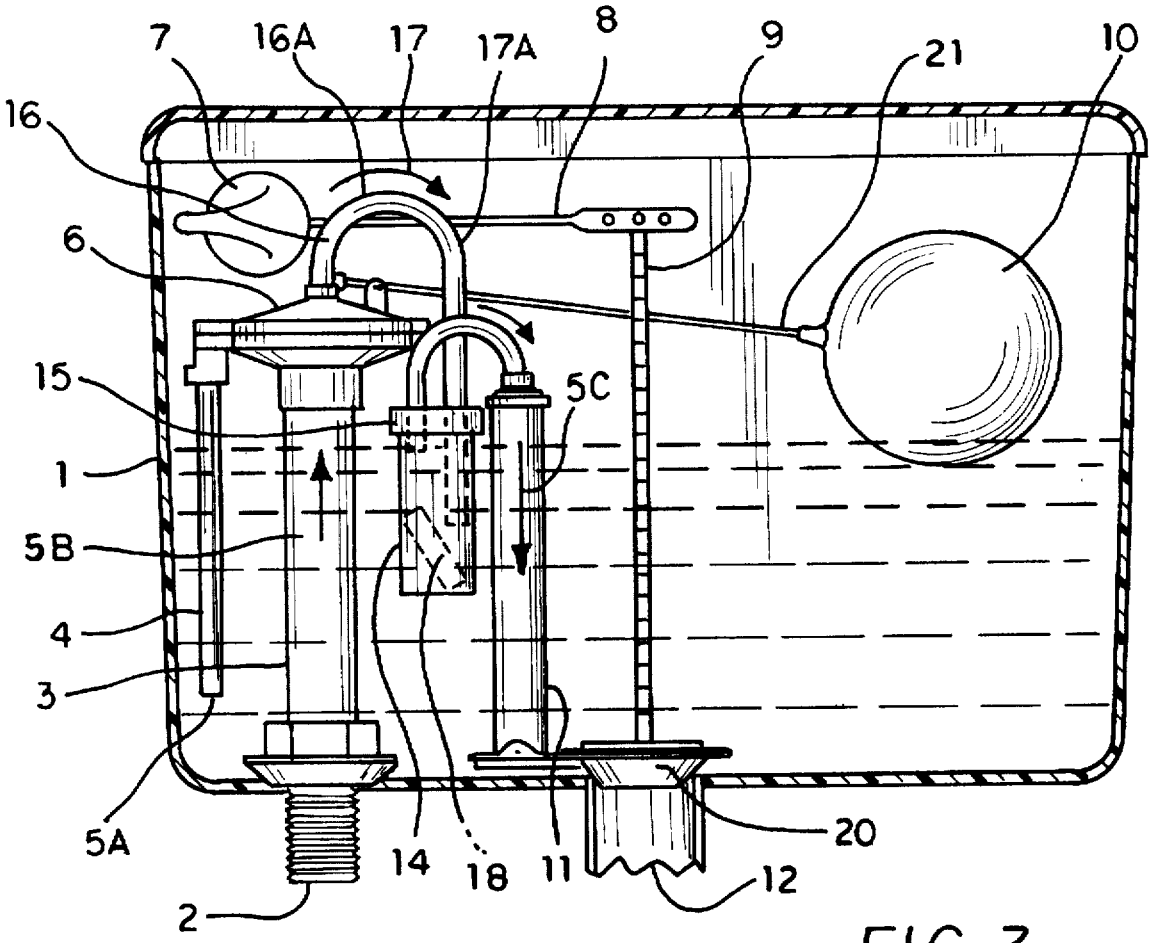
FIG. 3 is a cross sectional view of a toilet tank showing the connections to and the location of an agent chamber.

The way in which this is accomplished can be explained with the aid of FIGS. 1, 2 and 3. In FIG. 1, a prior art toilet tank is shown. The elements in this Figure includes a tank 1, a flush knob 7, a flush lever 8, a chain 9, a flapper valve 20, an exhaust port 12, a water inlet port 2, an inlet water pipe 3, a main outlet pipe 4, a water inlet valve 6, a bowl refill line 19, a bowl refill tube 11, a cleaning agent 18, a float 10 and arrow 5A showing the direction of water flow from the main outlet pipe, arrow 5B showing the flow in the inlet water pipe 3, and arrow 5C showing the the flow of the water in the bowl refill tube 11. The tank has a top near the flush knob 7 and a bottom near the flapper valve 20.

In this prior art system, the water inlet port 2 forms the inlet port to the water inlet pipe 3. The water inlet pipe is mounted in position in the tank by being affixed at its lower edge to the bottom of the water tank. The water inlet valve 6 is mounted on top of the water inlet pipe 3. The main water outlet pipe 4 is connected to and extends down from the water inlet valve 6.

The primary flow path of water through the tank, as indicated by the arrows 5A and 5B, is from the inlet water port 2, through the inlet water pipe 3, through the water inlet valve 6, and finally through the main water outlet pipe 4 from which the water is discharged into the tank. The flush knob 7 is rotatably connected through the tank wall to a first end of flush lever 8. The second end of the flush lever is connected to a first end of the chain 9. The second end of the chain 9 is connected to the flapper valve 20. The flapper valve is designed to remain closed until it is opened by means of lifting chain 9. To initiate the flushing cycle, the flush knob is rotated. This rotation raises the flush lever, pulling up the chain 9 and lifting the flapper valve to release the water through the main exhaust port 12. The flapper valve remains open until essentially all the water in the tank has drained through the exhaust port and past the toilet bowl, which all occurs in a matter of seconds.

The float 10 is designed to float on top of the water in the tank and is connected to the water inlet valve 6, by means of the float lever 21. As water enters the tank through the inlet water pipe 3, and then flows through the main outlet water pipe 4 in the direction shown by the water flow arrows 5A, the tank fills and the float rises. Once the water has reached a level of approximately three quarters of the height of the tank, the float lever causes the inlet valve 6 to shut off and terminate the flow of inlet water into the tank. The conventional cleaning agent 13 in block form, dissolves in the water contained in the entire tank. On the next flush cycle, most of the dissolved agent is flushed down and out the waste line, wasting most of the agent's effectiveness in cleaning the toilet bowl itself.

In addition to the primary flow path described above, there is a secondary path which leaves the valve 6, passes through the bowl refill line 19 to the bowl refill tube 11. The upper end of the bowl refill tube is considered the end connected to valve 8. The bowl refill tube 11 is connected to the flapper valve mounting, but bypasses the flapper valve, such that even though the flapper valve is closed, water can continue to flow around the flapper valve through this secondary path. At the completion of the flush cycle, the tank is drained and the flapper is closed. The secondary path allows water to continue to enter the toilet bowl and fill it as the water rises in the tank. Once the float has risen to a set position, it shuts off the water inlet valve and also stops the flow of water through the secondary path into the toilet bowl.

The agent chamber is shown in FIG. 2. The agent chamber 14 includes a cap 15, with two sealed lines, the inlet line 16A and outlet line 17A passing through the cap into the interior of the chamber. These lines are sealed to the cap about the outside periphery of that portion of the lines that is contact with the cap. A cleaning agent 18 is located in the lower portion agent bottle 14. Water entering through the inlet tube 16A, passes into the chamber and about the agent 18. The water then continues to flow past the agent 18 absorbing some agent which is expelled through outlet line 17A when water continues to flow into the inlet line.

FIG. 3, shows a water tank including the agent chamber 14 placed between the inlet water pipe 3 and the bowl refill tube 11. In effect, the bowl refill line 19 is divided with the portion coming from the inlet valve 6 forming the inlet line 16A and the remaining portion of toilet bowl refill line 19 forming the outline 17A. The water normally used in the secondary path for refilling the bowl is first passed through the agent chamber. Only the water used to refill the bowl has agent dissolved in it and this water remains in the bowl until a subsequent flushing sequence occurs, thereby providing extended cleaning and deodorizing benefits.

The water entering the tank through the inlet water pipe 16 is under pressure normally found in the cold water lines generally used to supply water to toilets. This pressure is passed through the inlet valve to the refill line. Although the water pressure entering the refill line is reduced from that which enters the inlet valve, it is still sufficient to force the water that is in the agent chamber out into the bowl during the refill cycle. The water that has been forced out has been left to absorb the cleaning agent in the agent chamber over the time period between flush cycles and therefore typically contains a sufficient amount of the cleaning agent to carry out a cleaning operation on the bowl while it resides there between flush cycles.

The cap 15, on the agent chamber 14 is removable to permit placing various types and sizes of agent into the chamber. Agents ranging in size and form from pellets to blocks can be used with equal success. Chlorine pellets, typically used for pools, and which can be obtained in bulk at low cost are excellent for this purpose. Unlike "throw away" wire holders used for agents in block form in prior art systems, the agent chamber can be used continuously.

Figure 4:
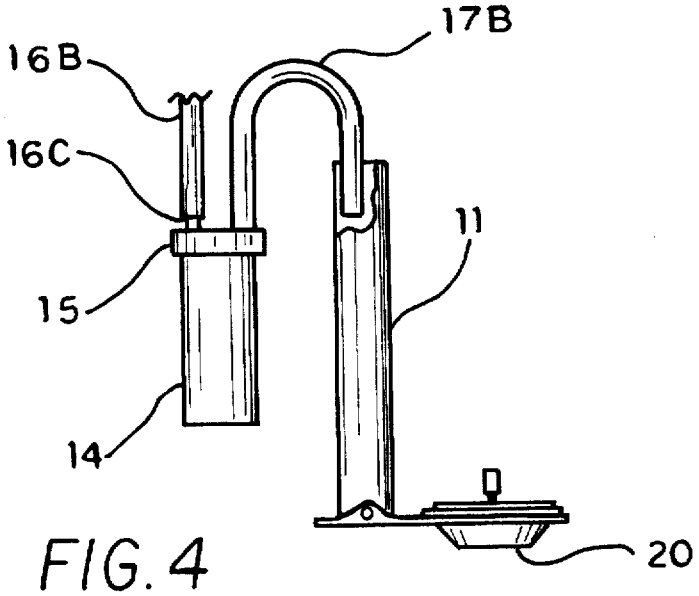
FIG. 4 is a detailed view of an alternative form of chamber cap which includes a rigid outlet tube formed in an inverted "U" shape to support the chamber in the tank.

FIG. 4 shows an alternative arrangement for the agent chamber and cap. In this Figure, a rigid outlet tube 17B replaced the flexible outlet tube shown in FIG. 2. Tube 17B is formed as an inverted "U" which can easily be hooked into the toilet bowl refill tube for support. The end of the outlet tube 17B which is hooked into the refill tube permits water that has flowed through the agent chamber to empty into the refill tube. The opposite end of rigid tube 17B is rigidly connected to the agent chamber cap. The rigid tube 17B accepts water entering it from the agent chamber, but also supports the cap and the agent chamber by way of its rigid connection to the cap and its position when hooked into the refill tube.

The cap 15 also includes a short rigid portion of the inlet tube referred to by drawing numeral 16C. A longer flexible portion of the inlet tube, referred to by drawing numeral 16B, is connected to the rigid portion of the inlet tube 16C by forcing the flexible portion over the rigid portion as shown in FIG. 4. This alternate configuration of the agent chamber inlet and outlet tubes shown in FIG. 4 permits easy refilling of the agent chamber with an agent and the easy replacement of the agent chamber in its position in the toilet tank. The agent chamber is simply unhooked from the refill tube and lifted a short distance upward from the toilet tank. The flexible inlet tube 16B is then removed by pulling it off from the rigid portion of the inlet tube 16C. This completely frees the agent chamber from the tank. It can then brought to any convenient area where the cap can be removed and a new supply of agent can be placed in the chamber.

Note that in FIG. 2 there is an extension of the inlet tube 16D that is located inside the agent chamber and that this extension ends near the bottom of the agent chamber. This extension is designed to insure that each time water is taken into the agent chamber, it places the inlet water in the bottom of the chamber and forces out into the toilet bowl the water which has previously laid in the lower portion of the chamber and had absorbed the cleaning and/or deodorizing agent located there.

Although several embodiments have been shown in FIGS. 2,3, and 4, other alternative embodiments are possible that remain within the spirit and scope of the invention. For example, various types of containers can be substituted for the agent chamber. In one such alternative embodiment, the bowl refill tube is used to serve two functions. The first is its normal function as the refill tube, while the second is as the agent chamber. This arrangement eliminates the need for a separate agent chamber. All that is basically necessary to accomplish this double use is to add a screen at the bottom of the bowl refill tube to prevent the agent in pellet or powder from leaving the tube until dissolved. The tube can be made wider to accept more agent, if that is desired. Faster dissolving agents are required in this embodiment, unless an exhaust tube is extended up through the bowl refill tube to serve as the drain for the bowl refill tube. With such an exhaust tube in place, water would remain in the bowl refill tube between flushes to give the agent time to dissolve. A refill cap is not necessary for this embodiment, but a threaded removable refill tube is of advantage to facilitate removal and cleaning this embodiment.

Accordingly, this invention is limited only by the following claims:

Having described my invention I claim:

1. A toilet tank in combination with a cleaning/deodorizing agent dispenser, said toilet tank having a bottom and a top and consisting of:

water inlet means for supplying water to said tank at the bottom, a water inlet pipe having a lower end connected to said water inlet means and an upper end, a water inlet valve mounted to said upper end of the water inlet pipe, a primary water outlet connected to said water inlet valve for discharging water into said tank, a secondary water outlet port connected to said water inlet valve, a float connected to said water inlet valve by means of a lever to shut off the water inlet valve when water in the tank rises to a predetermined level, an exhaust port at the bottom of said tank, a flapper valve positioned above said exhaust port for releasing water from the tank into a toilet bowl through said exhaust port when said flapper valve is in an opened position and retaining water in the tank when said flapper valve is in a closed position, and a bowl refill tube extending from the bottom of the tank and communicating with said exhaust port;

said cleaning/deodorizing agent dispenser being disposed intermediate said water inlet pipe and said bowl refill tube and consisting of:

a cylindrical container having a closed bottom and an open top, a removable cap for sealingly engaging the open top of said container, said cap having a inlet port and an outlet port, an inlet tube connected at one end to said secondary water outlet port, another end of said inlet tube passing through the inlet port of said cap and terminating proximate said closed bottom of said container, an outlet tube communicating at one end with said bowl refill tube, another end of said outlet tube passing through said outlet port and terminating proximate said cap, and a solid capsule of concentrated cleaning/deodorizing agent disposed at the bottom of said container.

2. The combination according to claim 1, wherein said inlet tube and said outlet tube are fabricated of a flexible material.

3. The combination according to claim 1, wherein said outlet tube is configured as an inverted U and fabricated of a rigid material.

* * * * *